US006069563A

United States Patent [19]

Kadner et al.

[11] Patent Number: 6,069,563

[45] Date of Patent: May 30, 2000

[54] SEAL SYSTEM

[76] Inventors: Steven P. Kadner, 8401 Washington Pl., NE., Albuquerque, N.Mex. 87113; William M. Resnik, 9700 Compadre La. NE., Albuquerque, N.Mex. 87111; Micha Auerbach, 16 Hachardoshet Street, Or-Yehuda 60375, Israel

[21] Appl. No.: 08/810,454

[22] Filed: Mar. 4, 1997

Related U.S. Application Data

[60] Provisional application No. 60/012,876, Mar. 5, 1996.

[51] Int. Cl.[7] ..... G08B 13/14

[52] U.S. Cl. ..... 340/571; 340/541; 340/542; 340/539; 340/652; 70/38 A; 70/38 B

[58] Field of Search ..... 174/655 S, 17.08, 174/50.5, 50.52, 50.54; 292/307 R, 307 A, 327; 340/568, 572, 571, 825.06, 541, 562, 539, 652, 565, 657, 661; 70/38 A, 38 B

[56] References Cited

U.S. PATENT DOCUMENTS

| | | | |
|---|---|---|---|
| 4,750,197 | 6/1988 | Denekamp et al. | 455/404 |
| 5,056,837 | 10/1991 | Fuehrer | 292/307 R |
| 5,097,253 | 3/1992 | Eschbach et al. | 340/545 |
| 5,127,687 | 7/1992 | Guiler | 292/327 |
| 5,169,188 | 12/1992 | Kupperman et al. | 292/307 R |
| 5,189,396 | 2/1993 | Stobbe | 340/541 |
| 5,406,263 | 4/1995 | Tuttle | 340/572 |
| 5,421,177 | 6/1995 | Sieber et al. | 70/57.1 |
| 5,587,702 | 12/1996 | Chadfield | 340/542 |
| 5,656,996 | 8/1997 | Houser | 340/541 |

*Primary Examiner*—Benjamin C. Lee
*Attorney, Agent, or Firm*—David W. Carstens; Carstens, Yee & Cahoon

[57] ABSTRACT

The seal system is comprised of a custom integrated circuit utilizing a special CMOS gate-array technology that can be utilized to build inexpensive tamper-resistant electronic seals. The electronic circuit includes a special analog as well as digital, single-chip circuitry that senses the state of the seal, and when interrogated, transmits that state via a 35-bit data word to a seal reader device, allowing remote monitoring and control of containers and expensive goods. Any attempt to tamper with the seal will be recorded in the circuit for later transmittal to the hand-held seal reader/verifier. Each seal has a unique 20-bit identification number, combined with a 6-bit random seal code and a 6-bit resistance value. The seal electronics may be utilized in a way to provide several types of seals, namely, a shipping container seal, an event triggering seal, and event logging seal, and a tamper-proof seal as well as combinations thereof.

12 Claims, 6 Drawing Sheets

FIG. 1
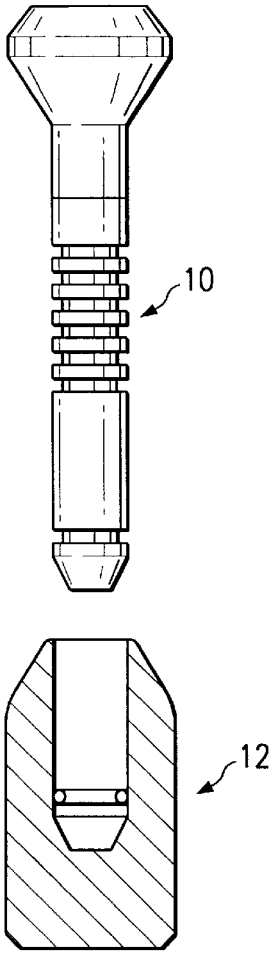
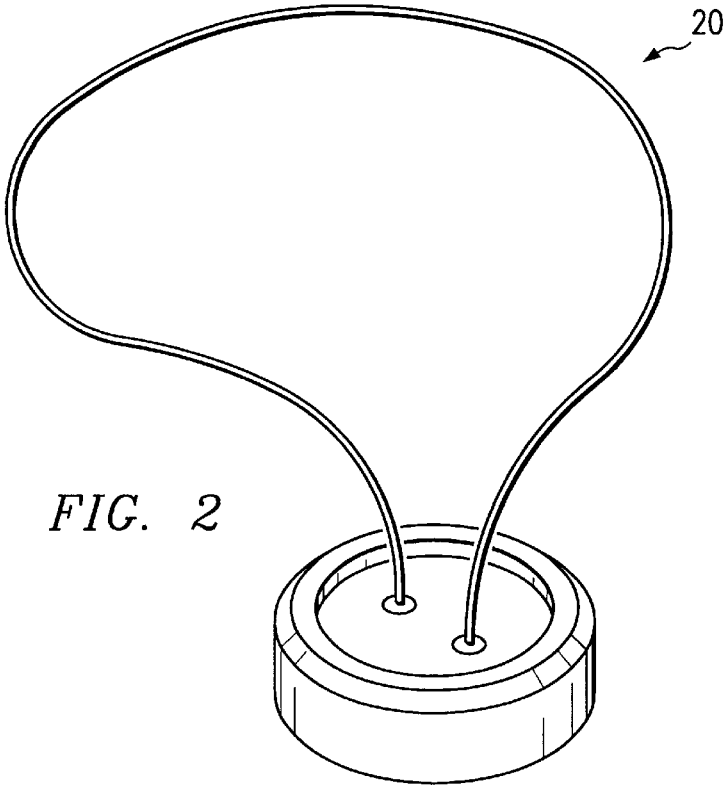
FIG. 2
FIG. 4
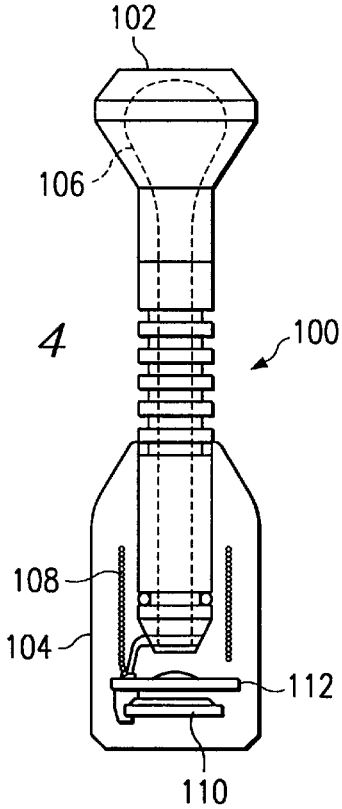
FIG. 4a
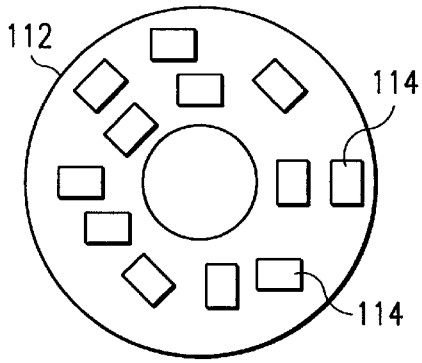
FIG. 4b
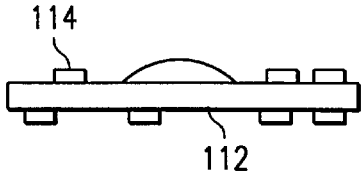

SEAL SYSTEM

This is a provisional Application Ser. No. 60/012,876 filed Mar. 5, 1996.

TECHNICAL FIELD OF THE INVENTION

This invention relates to a device used to detect tampering or unauthorized access to international shipping, transport, and/or storage containers. This seal device actively detects and indicates attempts to tamper with or access a container onto which it is affixed.

BACKGROUND OF THE INVENTION

Containers currently being used for transport and storage of sensitive or valuable materials are vulnerable to theft or malicious tampering. Currently, small, inexpensive mechanical seals are used to detect and validate theft attempts and tampering. These small, mechanical seals are typically standard metal, plastic, and wire devices whose casing is printed with a unique serial number. A mechanical seal used in the international shipping industry is shown in FIG. 1.

In this type of seal, the metal pin 10 is inserted into the plastic casing 12 until a latch is sprung, permanently locking the metal pin inside the casing. Because the sealed container may not be opened without visibly damaging or destroying the seal, the serial numbers printed on these seals are tracked and the casing/pin enclosure is visually inspected for external evidence of tampering. Once the transport container has arrived at the shipping destination, the seal is broken in order to open the container. Upon its removal, the seal is examined carefully for signs of mechanical tampering and possible attempts at repair. However, because this type of seal is only inspected visually, the security of the containers can be easily compromised with an accurate reproduction of a seal with the original serial number stamped on its casing. Additionally, detection of seals that are broken and repaired or replaced requires close visual inspection. Human error is a significant factor during a subjective visual inspection of mechanical seals. Also, detailed forensic examination of mechanical seals for signs of tampering usually cost more than the seal itself.

Another type of inexpensive seal currently used in the transport and storage industries is mechanical wire seals 20, similar to that shown in FIG. 2. These seals are easily affixed to a container and provide a reliable seal. They, too, must be examined carefully upon removal for signs of counterfeiting, cutting and repair, stretching, and other indications of tamper. The examinations often require the use of expensive microscopy equipment and take some time. Hence, the major cost of this type of seal is borne in its examination, rather than the cost of the actual seal.

Expensive active electronic seals are used by agencies that are charged with the storage of critical materials such as nuclear and other hazardous materials. An example of this type of seal is the active fiber-optic seal 30 shown in FIG. 3. A fiber optic loop 32 is woven through hasps on the container. Each end of the fiber optic cable is attached to a protected electronic circuit 34. At either regular or random intervals, a pulse of light is sent into the cable. A detector on the other end of the cable looks for this pulse. If the pulse is detected, then the processor in the seal assumes that the fiber optic loop has stayed closed and, therefore, no tamper of the seal is evident. If the pulse is not detected, the seal processor logs the event as a potential tamper. Each event is stored within the seal by its microprocessor with a time stamp. A personal computer serial interface is used to read the event registers in the seal. This type of seal provides an extremely high degree of tamper resistance along with quick tamper determination but at a relatively high cost. However, the cost of inspecting, reading, and evaluating the seal is very low.

A need exists for a seal system that incorporates the reliability and verifiability of sophisticated electronic safeguards with extremely low purchase and inspection costs.

SUMMARY OF THE INVENTION

The ARGUS seal is an electronic device developed to detect and report tamper events. Various embodiments of the seal are made possible by the custom circuitry developed solely to provide sealing functions. In all embodiments of the seal, the invention comprises a battery, a mechanical enclosure (seal body), a wire loop, and a low power hybrid circuit board. The invention further comprises analog measurement circuitry, a R.F. interface coil, a tamper-resistant wire, a microcontroller, memory, an event trigger interface, and a serial interface connection (see FIG. 5*c*). The specific lifetime of the ARGUS seal is dictated by the size and capacity of its battery and can be designed and produced according to specific user needs. The ARGUS seal device may also be configured to electronically trigger a camera, other recording device, or another event-triggered activity specific to individual shipping or storage needs. The seal is interrogated and evaluated by using a hand-held seal reader/verifier with hardware and software designed to analyze, display, organize, and store information transmitted and received from the seal component.

The various embodiments of the invention resemble current standard mechanical seals such as those discussed above. Because the external structure of the ARGUS seal can be configured identically to current mechanical seals, no retooling is necessary to incorporate use of an ARGUS seal. This means that the ARGUS seal can be considered an electronic seal as well as a standard mechanical seal.

The ARGUS seal is activated and programmed with the hand-held seal reader/verifier at the time that the container is sealed. Once the seal is activated and programed, the seal is capable of being read at any time from a hand-held seal reader/verifier. Tamper information from the seal is transmitted to the hand-held seal reader/verifier and stored for future processing. The stored data is comprised of the seal ID number (20 bits), the sealing event random code (6 bits), and the wire-specific resistance value (6 bits). The stored data together with three pilot bits make up a 35-bit data word that is transmitted from the seal to the external world following each reception of a signal from the hand-held seal reader/verifier. Transmission time is approximately 10 milliseconds as a pulsed R.F. signal with a 1 Mhz carrier frequency for the short distance applications (a few meters) and about 1 GHz carrier frequency for the large distance applications (up to a few hundred meters).

The present seal operates in two modes: a sleep mode and an active mode. The active mode is initiated when the user interrogates the seal by sending a wake-up signal from the hand-held seal reader/verifier. This wake-up signal is sent when the user illuminates a reflector on the seal with the laser pointer, which is connected to the hand-held seal reader/verifier, and presses a button. The wake-up signal can be an uncoded R.F. burst of 10 milliseconds, 1 Mhz signal directed to one unidentified seal, or a coded signal to allow communication with one specific seal that is part of a large group of seals.

The seal's electronic circuitry includes a random number generator as well as an analog to digital measuring circuit to allow measurement of analog parameters, such as resistance, temperature, or pressure. The random number generator is part of a dynamic random coding scheme that ensures specific seal information for each sealing event. A very small, constant current is drawn during the sleep mode of operation to maintain security during non-transmission periods. If this current is interrupted, the original transmission code is lost and replaced with a randomly generated code. This change in the random code is a reliable indication that the seal has been tampered with or broken between transmissions.

The typical current draw during sleep mode is 1 to 2 $\mu$A, whereas the current load for the active measurement mode of operation is 100 to 200 $\mu$A. Such low current consumption can guarantee active seal lifetimes ranging from a few weeks to a few years, depending on the size of battery and the user's specific needs. The estimated battery life of the seal, the number of remote interrogations of the seal, and the distance of transmission are pre-adjusted according to specific user needs. The power transmitted from both the hand-held seal reader/verifier and seal is within FCC regulations.

As previously mentioned, the wake-up signal begins a measuring and transmitting cycle in the seal. This cycle electronically measures individual resistance characteristics of each wire seal and encodes it into the transmission information. Once the information has been transmitted, the software in the hand-held seal reader/verifier receives and analyzes it. The software interface then indicates whether the seal has been broken or tampered. Finally, the transmitted information is stored and classified within the hand-held seal reader/verifier for reference.

BRIEF DESCRIPTION OF THE FIGURES

For a more complete understanding of the present invention, and for further details and advantages thereof, reference is now made to the following Detailed Description taken in conjunction with the accompanying drawings, in which:

FIG. 1 is a plan view of a typical mechanical seal currently used in the shipping industry;

FIG. 2 is a plan view of a mechanical wire seal used in the transport and storage industries;

FIG. 4 is a plan view of an embodiment of the shipping container seal;

FIGS. 4*a* and 4*b* are a top view and a horizontal view of a hybrid circuit of the shipping container seal of FIG. 4;

DETAILED DESCRIPTION OF THE DRAWINGS

Figure 3B:
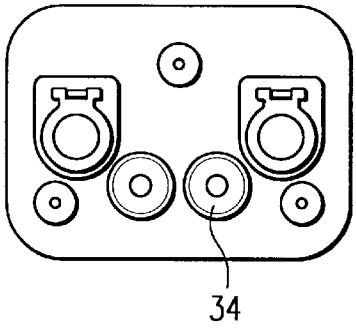
FIG. 3 is a plan view of a fiber optic seal used in the storage of nuclear and other hazardous materials.
Figure 3A:
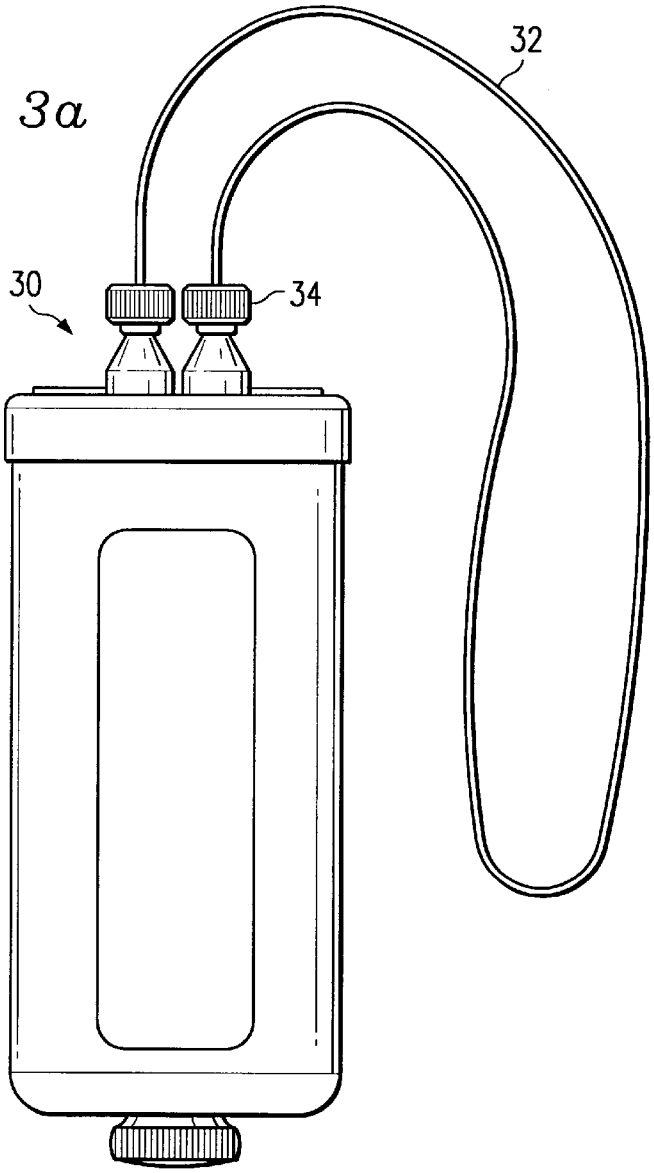

The shipping container seal 100 of FIGS. 4, 4*a* and 4*b* overcomes many of the disdvantages found with prior art shipping container seals. The seal 100 is comprised of several components including a pin 102 and a seat 104. A wire loop 106 is contained within the pin 102 of the mechanical seal. A transmission coil 108, a battery 110, and a hybrid circuit 112 are located within the seat 104. When the pin 102 is pushed into the seat 104 and mechanically locked, contact is made between the wire loop 106 and the electrical contacts 114 of the circuit 112. Once the circuit is complete, the system can be activated with the hand-held seal reader/verifier.

FIGS. 5, 5*a*, 5*b*, and 5*c* illustrate alternate embodiments of the seal known as a fiber-electric seal. The fiber-electric seal 200 can be an event logging seal, a tamper proof seal, or an event triggering seal. In each case the hardware is essentially the same, but the method of operation differs. An event logging seal 200, shown in FIG. 5 and 5*c*, consists of the wire loop 202, battery 204, a hybrid circuit 206, and a polling circuit 208. It is a hybrid circuit because it uses a custom chip that is soldered to a printed circuit board along with commercial off-the-shelf electronic components. The polling circuit, based on a commercially available microcontroller would periodically poll the hybrid circuit 206, looking indication of a tamper to the sealing wire 202. If a tamper is indicated, the microcontroller is programmed to log the tamper event along with a date/time stamp inside its internal memory. The microcontroller portion of the seal unit could then be interrogated by serial touch contact with an external device (such as a palmtop computer) or through the R.F. interface. The interrogation yields an event report for the seal.

Figure 5:
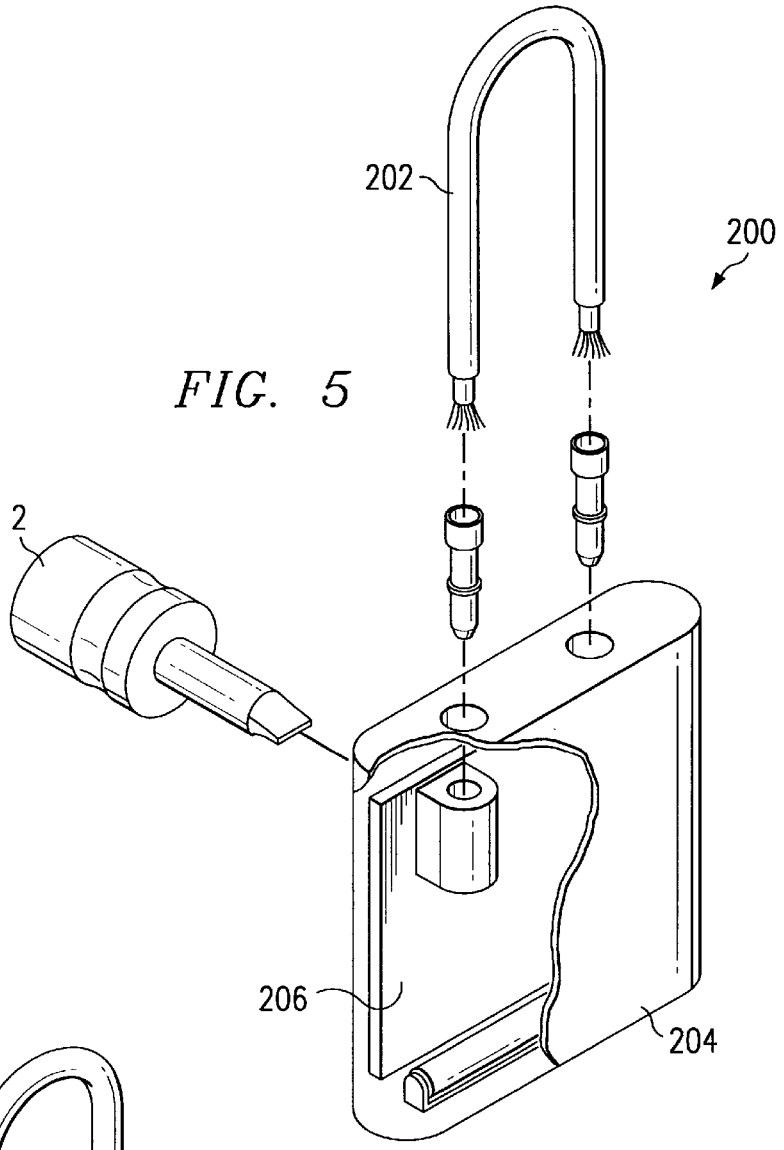
FIG. 5 is a plan view of an a fiber-electric seal.
Figure 5A:
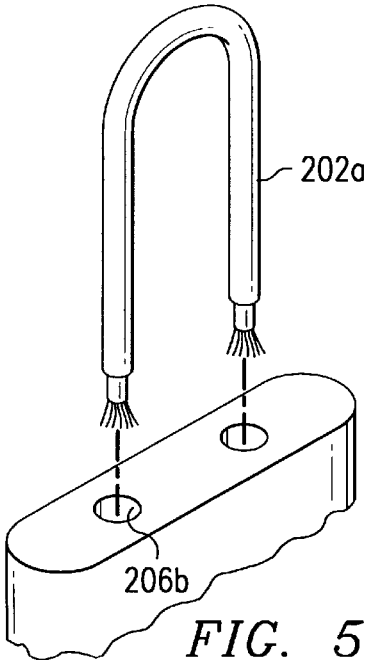
FIG. 5*a* is a plan view of an optional sixteen-stranded isolated resistance wire for the fiber-electric seal of FIG. 5.
Figure 5B:
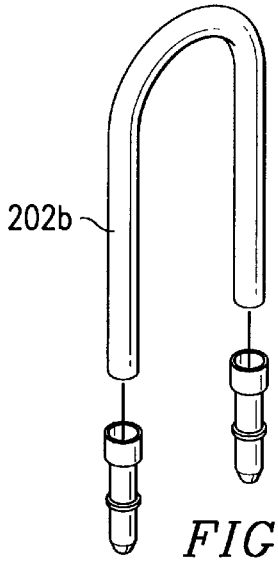
FIG. 5*b* is a plan view of an optional conductive plastic wire loop with changeable resistance for the fiber-electric seal of FIG. 5.

There are two options for sealing bands with the fiber-electric seal: a multi-strand wire 202*a* shown in FIG. 5*a* and conductive plastic wire 202*b* shown in FIG. 5*b*. They each have different resistance as a result of the internal structure of the wires themselves. In the case of the multi-stranded isolated wires 202*a*, the two metal connectors at the end of the wires are clamped to some of the internal wires in an unpredictable way resulting in different end-to-end wire resistance. In the case of the conductive plastic sealing band 202*b*, the internal structure of the conductive material is such that, for each unit, there is a different end-to-end resistance. As shown in FIG. 5, the two metal connectors of the sealing band are hooked into the seal body in such a way that they cannot be measured from the external world. In other words, the contact points between the loop and the circuit are inaccessible. Hence, it is not possible to measure the actual resistance without breaking the seal body.

The tamper resistant seal 200 consists of the wire loop, battery, and custom hybrid circuit as a minimum. Like the event logging seal discussed above, it may also include a polling circuit that is based on a commercially-available microcontroller. The polling circuit periodically polls the custom hybrid circuit, looking for indication of a tamper to the sealing wire. The key to the tamper resistant seal is the sealing wire loop and the mechanical mechanism for affixing the wire loop to the seal body 204. The multi-strand tamper resistant sealing wire 202*a* is depicted in FIG. 5*a* and provides the fiber-electric properties of the seal. The sealing wire is affixed to the container then to the seal body itself by a simple screw-in mechanism. The end of the sealing wire is introduced into the seal through a hole 206*b* in the seal body as shown in FIG. 5*a*. A screwdriver 2 is used to clamp the wire within the seal body 204. This clamping action simultaneously spreads the wire fibers and strips the enamel insulation from the wire fibers so that they may make electrical connections inside the seal. A random number of the wire fibers make the connection, while the remainder of the fibers do not make an electrical connection. This results in a statistically random resistance of the sealing wire that is a function of the number of wires making contact and the length of the wire. When the seal is placed on the container, the seal electronics will measure the resistance of the wire and store it in the last 6 bits of the 35-bit data word. The seal is interrogated by the reader at the time of sealing in order to log the resistance value (and the rest of the 35-bit data word) as the sealing baseline.

As with the event logging seal, two possible sealing bands may be used, either a multi-strand wire or a conductive plastic wire. Regardless of the type of sealing bands used, any attempt to either cut and re-splice the wire or remove the wire from the seal body and re-insert will result in a high probability that the resistance of the wire will change. When this occurs, the next time the seal is interrogated, it will re-measure the wire resistance and change the value accordingly. When the wire is cut or removed and then placed back, the seal also generates a new 6-bit random sealing code and places the new code in bits 24 through 29 of the 35-bit data word. The seal reader, noticing that the random sealing code and the resistance value have changed, then reports the tamper event. The tamper resistant seal concept can also be applied to the shipping container seal, the event logging seal, and the event triggering seal.

Figure 7:
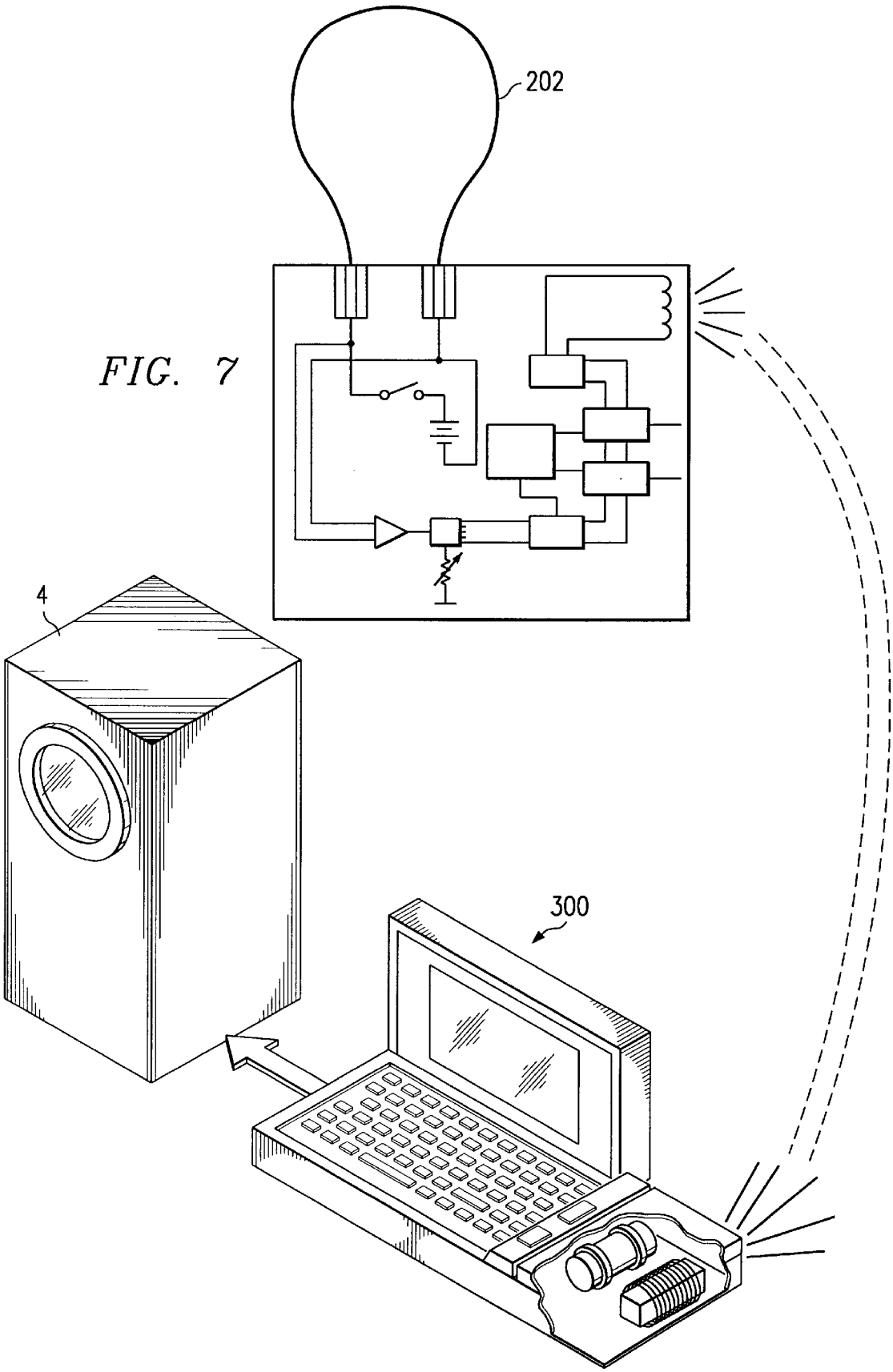
FIG. 7 is a plan view of an event triggering fiber-electric seal with a camera and a hand-held seal reader/verifier.

The event triggering seal, shown in FIG. 7, consists of the wire loop, either multi-strand wire or conductive plastic wire, a battery, a hybrid circuit, and a polling circuit. The polling circuit, based on a commercially-available microcontroller periodically polls the custom hybrid circuit, looking for indication of a tamper to the sealing wire. If a tamper is indicated, the microcontroller is programmed to initiate a triggered event. For example, the circuit may send a command to a digital camera 4 to take a picture. The event triggering seal also has the option of logging events for the specific needs of the user.

Figure 5C:
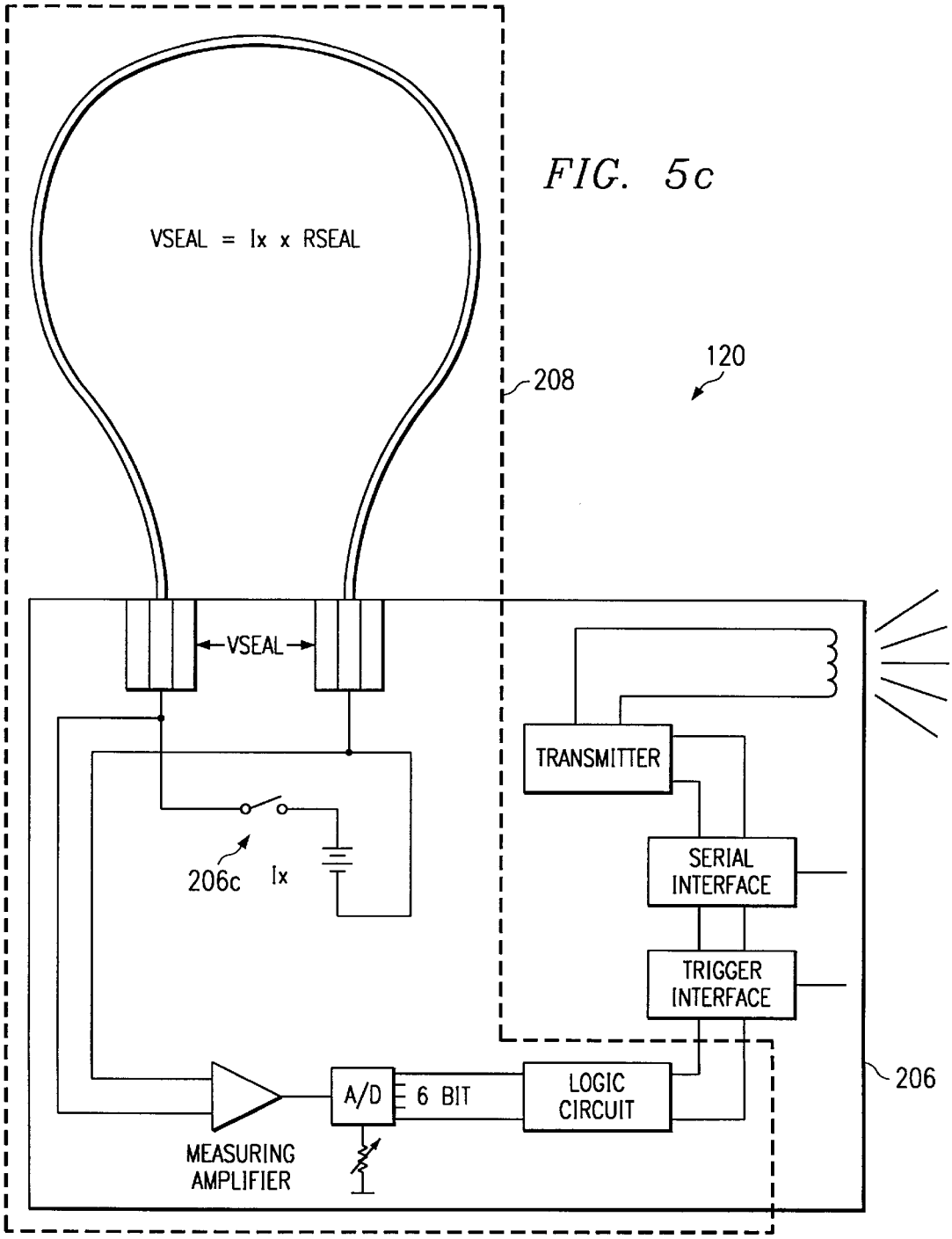
FIG. 5*c* is schematic diagram of an electronic circuit for the fiber-electric seal.
Figure 6:
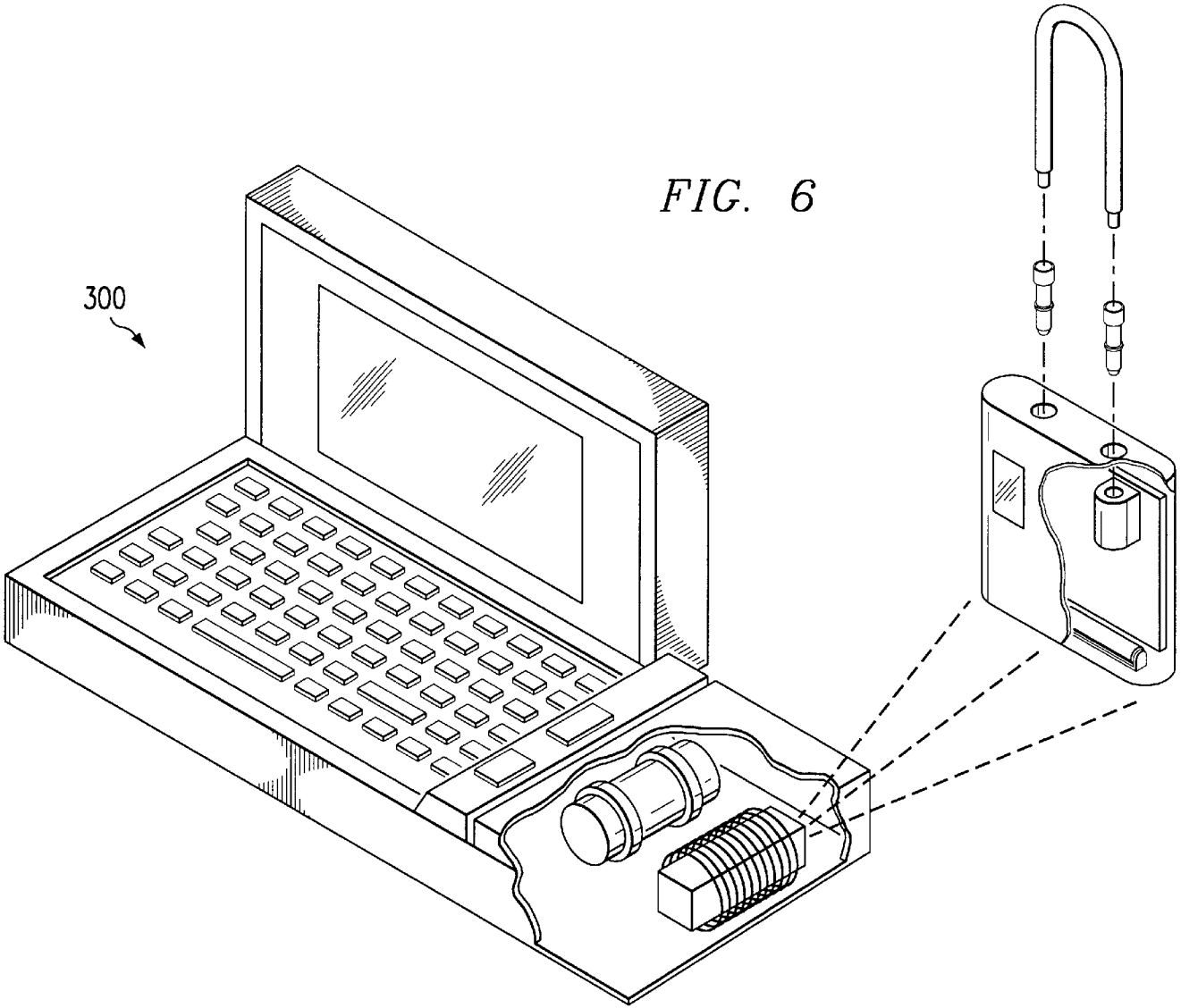
FIG. 6 is a plan view of the hand-held seal reader/verifier with laser pointer.

Either the shipping container seal or the fiber-electric seal can be activated by the transmission of a trigger signal from the hand-held seal reader/verifier 300 shown in FIG. 6. The radio frequency receiver on the circuit in the seal device senses the R.F. signal trigger and commences to charge an internal transmission capacitor to a higher voltage of between eight to ten volts for the purpose of data transmission. The second phase of the cycle begins when the circuit turns off the voltage converter 206*c* shown in FIG. 5*c*, and sends a 200 $\mu$A current through the wire loop for resistance measurement. This measurement varies specifically for each wire loop or sealing event. As can be seen in FIG. 5*c*, the internal current source of 200 $\mu$A can be calibrated together with the A/D converter so that the dynamic range of the measured voltage across the seal connectors is matched to the dynamic range of the internal measuring amplifier. This matching will be necessary for each seal embodiment. The voltage drop across the wire loop is measured and is converted to a digitized 6-bit data word by the A/D circuit. With other information (pilot code, seal ID, and random sealing code) the data are coded into a 35-bit data word for transmission.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention definition is intended to encompass such rearrangements, modifications, and substitutions of parts and elements as fall within the scope of the appended claims.

We claim:

1. A seal system comprising:

(a) a pin containing a conductive loop;

(b) a seat for accepting said pin, wherein said seat contains a monitor circuit which creates a circuit with the conductive loop when the pin is accepted by said seat, and wherein said monitor circuit comprises a tamper detector which detects at least tampering with said conductive loop.

2. The seal system of claim 1 wherein said monitor circuit comprises a plurality of spaced connectors for pressing contact with said wire loop, wherein an electrical resistance can be measured for the wire loop through said connectors.

3. The seal system of claim 1 further comprises:

(c) a remote activation means.

4. The seal system of claim 3 wherein said remote activation means comprises a radio frequency transceiver.

5. The seal system of claim 3 wherein said remote activation means comprises a transceiver having a serial interface.

6. The seal system of claim 3 wherein said remote activation means comprises a polling means for determining if a tamper event has occurred.

7. A seal system comprising:

(a) a seal body with loop engaging means;

(b) a conductive loop having a nonuniform impedance engaged with the loop engaging means of the seal body;

(c) resistance measurement means to measure a resistance formed in the loop; and (d) storage means to store the measured resistance indicative of the status of the seal system.

8. The seal system of claim 7 wherein said conductive loop comprises wires.

9. The seal system of claim 7 wherein said conductive loop comprises a plastic wire loop.

10. The seal system of claim 7 further comprises:

(e) a remote interrogation device for interrogating said storage means.

11. A method of detecting a tamper event for a container comprising the steps of:

(a) sealing the container with a pin containing a conductive loop and a seat for accepting said pin;

(b) measuring the resistance of the loop at a first time;

(c) measuring the resistance of the loop at a second time; and (d) triggering an event indicating device if the resistance of the loop at said first and second times are not equal.

12. The method of claim 11 and wherein said event indicating device is a digital camera.

* * * * *